US006669841B2

(12) United States Patent
Morin

(10) Patent No.: US 6,669,841 B2
(45) Date of Patent: Dec. 30, 2003

(54) MARINE VESSEL FOR COLLECTING FLOATING DEBRIS

(75) Inventor: Rene J. Morin, Bois-des-Filion (CA)

(73) Assignee: Hewitt (Brockville) Ltd., Brockville (CA)

( * ) Notice: Subject to any disclaimer, the term of this patent is extended or adjusted under 35 U.S.C. 154(b) by 80 days.

(21) Appl. No.: 10/045,079

(22) Filed: Jan. 15, 2002

(65) Prior Publication Data

US 2003/0132154 A1 Jul. 17, 2003

(51) Int. Cl.[7] ..... E02B 15/04
(52) U.S. Cl. ..... 210/170; 210/242.1
(58) Field of Search ..... 210/170, 242.1, 210/242.3, 776, 747

(56) References Cited

U.S. PATENT DOCUMENTS 3,326,370 A * 6/1967 Caddick ..... 210/242.1
4,033,876 A * 7/1977 Cocjin et al. ..... 210/242.3
4,060,487 A 11/1977 Samsel
4,141,308 A 2/1979 Gainey
4,363,735 A 12/1982 Hook
4,921,605 A 5/1990 Chastan-Bagnis et al.
4,959,143 A * 9/1990 Koster ..... 210/242.3
5,028,325 A 7/1991 Hamilton
5,043,064 A 8/1991 Abell et al.
5,173,182 A 12/1992 Debellian
5,207,901 A 5/1993 Ravagnan
6,024,145 A * 2/2000 Ackles ..... 210/170

OTHER PUBLICATIONS

Hewitt Environmental Pamphlet entitled "The Rover 12" publicly disclosed circa Mar., 2001 (acknowledged prior art in the subject application).

* cited by examiner

*Primary Examiner*—Christopher Upton
(74) *Attorney, Agent, or Firm*—Trevor C. Klotz

(57) ABSTRACT

Marine vessels used for collecting floating debris from water employing a collection bucket which dumps debris in one spot directly behind the collection area are known. A debris collection bucket locatable in an open chamber, both of which having water passageways extending therethrough is disclosed. The bucket is movable between the open chamber and a debris dumping area. Gate means is provided which cooperates with the bucket. The gate is moveable between a gate open position permitting debris to enter the debris collection area, and a gate closed position impeding entry of debris when the bucket proceeds to dump collected debris. A primary boom which extends centrally and longitudinally of the vessel is pivotally connected to both the vessel and the bucket. The boom is telescopically and vertically movable between the debris collection area and the debris dumping area which can extend centrally along a substantial length of the vessel.

29 Claims, 4 Drawing Sheets

MARINE VESSEL FOR COLLECTING FLOATING DEBRIS

BACKGROUND OF THE INVENTION

The use of marine vessels to remove debris from the surface or water is well known. However, vessels that serve this function invariably suffer from one or more problems typical with such vessels, including higher maintenance requirements, slow travel speeds, relatively low limits on the amount and type of debris they are capable of collecting in a single outing, instability caused when debris is shifted on board the vessel, an inability to handle long or heavy debris objects, and an inability to accommodate the use of standard debris collection containers such as front loading or roll off containers.

My vessel combines the known elements of a hull having a tapered bow for speed and cost savings, movable port and starboard bow sections to allow for the ingress of debris bearing water, ballast means for raising and lowering the vessel relative to the surrounding water, together with novel gate means and/or a novel debris collecting bucket moving means to produce a fast, efficient, versatile, relatively simple and cost efficient debris collection vessel with a high debris carrying capacity and superior debris handling abilities as compared with anything existing in the prior art.

U.S. Pat. No. 4,921,605 issued May 1, 1990—Chastan-Bagnis et al., describes a debris removal apparatus having, among other elements, a comb and inclined grill combination wherein the comb serves to disengage debris such as algae or seaweed from the grill and to convey the debris over a spill way immediately aft of the grill. This method of collecting and dumping floating debris on board a vessel is, however, inflexible, inefficient and primitive. Such a debris removal system is not capable of effectively and efficiently collecting, handling and dumping large, unwieldy debris items or a large amount of debris.

The "Rover 12" is a known vessel manufactured by Hewitt (Brockville) Ltd. of Brockville, Ontario, Canada, and is specifically designed for debris collection. The Rover 12 employs a debris removal system having, instead of a comb and grill combination, a debris collection bucket and an independent gate to halt debris. This gate, however, is not well suited to debris collection operations in that it operates independently of the debris collection bucket. During debris collection operation, the gate lifts following the rise of the bucket and lowers once the bucket has returned to the original collection position. As a consequence, a downside of the Rover 12 arrangement is that debris can and often does make its way behind the gate as it is being raised, or becomes lodged below the bucket as it is being lowered. The Rover's gate design, although previously the best gate and bucket arrangement, is problematic and results in an inefficient debris collection operation with considerable down time for maintenance. A further shortcoming is that when the bucket of the Rover 12 collects debris, it travels vertically and pivots backwards to deposit debris immediately aft of the area in which it is collected. This debris removal system may be capable of collecting somewhat larger debris items than U.S. Pat. No. 4,921,605, but it too is incapable of dumping the collected debris anywhere except in the one area immediately aft of where the debris is collected. This inability to efficiently distribute collected debris on board the vessel seriously limits the amount of debris this vessel can collect in an outing and can adversely affect the vessel's stability. Moreover, the Rover 12 is also incapable of handling large, unwieldy debris items.

U.S. Pat. No. 5,173,182 issued Dec. 22, 1992—Delbellian, describes a vessel which collects debris from the water surface and dumps it in a debris collection container immediately aft of where the debris is collected. A pair of inboard cranes located on deck near the starboard and port sides of the vessel are used to replace a filled debris collection container with an empty one. This method of distributing collected debris onboard is inefficient and potentially dangerous to crew involved in the container movement process. The shifting of loaded debris collection containers requires considerable time and contributes to vessel instability. Also, the collection method employed by Delbellian is, like the apparatus described in U.S. Pat. No. 4,921,605 and the Rover 12, incapable of handling large, unwieldy debris items.

SUMMARY OF THE INVENTION

The present invention is directed towards a marine vessel used for collecting floating debris from surrounding water. The marine vessel includes the well known features of a hull having a tapered bow, port and starboard bow sections moveable laterally between bow open and bow closed positions, an apron located between the bow sections, a debris collection area aft of the apron, a debris dumping area midships and aft of the debris collection area, ballast means for selectively locating the apron between positions above and below the surrounding water, and means for causing the surrounding water to flow over the apron and through the debris collection area when the apron is below the surrounding water.

The marine vessel of my invention includes an open chamber located below and aft the apron and which has defining walls which include water passageways therethrough. It further includes a debris collection bucket having water passageways extending therethrough. The bucket collects debris when it is in a first position where the bucket is located in the open chamber and water containing the debris is made to flow through both the open chamber and the bucket. The vessel incorporates means for moving the bucket between the first position and a second position where the bucket is located at the debris dumping area.

In order to effectively prevent any entry of debris into the collection area when the bucket is removed from the open chamber, the vessel employs gate means on its apron. Advantageously, the gate means cooperates with the bucket and moves between a gate open position when the bucket is located in the open chamber to thereby permit debris to enter into the debris collection area, and a gate closed position to impede entry of debris into the debris collection area. Preferably, the gate means may have water passageways through it to facilitate water flow through the vessel when the gate is in the gate closed position. Since the gate means and the bucket cooperate one with the other so that the position of the gate means is dependent on the bucket, this debris collection system effectively prevents debris becoming lodged on top of the gate or finding its way in behind the gate. This way, a much more efficient debris collection operation is achieved than is possible with the vessels described in U.S. Pat. Nos. 4,921,605 and 5,173,182, and with the Rover 12.

Preferably, means for biasing the gate means in the gate closed position are provided. To this end, one or more extension fingers may be included on the bucket and engagable with a corresponding number of extension finger receiving means included on the gate means. Thus, when the bucket is in the first position, the extension fingers on the bucket maintain the gate means in the gate open position. As a consequence, the bucket remains in contact with the gate such that debris is not able to find its way behind the gate or lodge itself below the bucket.

In accordance with another aspect of my invention, the marine vessel can advantageously include a primary boom which extends centrally and longitudinally of the vessel with one of the boom ends being pivotally connected to the vessel rearward of the debris dumping area, while the other end is pivotally connected to the bucket. This primary boom is telescopically and vertically movable between the debris collection area and the debris dumping area. Further, the bucket is preferably movable from a debris collection position in the debris collection area to a debris dumping position when in the debris dumping area. The primary boom provides the very desirable capability in a debris collection vessel of being able to place collected debris in areas other than the one area directly aft the collection area. Moreover, as the boom moves centrally and longitudinally relative to the vessel, its movement as well as the debris it dumps do not adversely affect the stability of the vessel. In fact, up to a point, the more debris evenly distributed centrally and longitudinally of the vessel, the more stable the vessel may become. Also, the boom is capable of assuming a position whereby its overall height can be minimized to accommodate situations where overhead clearance is an issue.

In accordance with another aspect of my invention, provision can advantageously be made for a secondary boom which is telescopically movable relative to the primary boom and is located at the other end of the primary boom. The secondary boom has grappling means located at its distal end for grappling debris forward of the debris collection area and can be in the form of a pair of pincers pivotally connected to the distal end of the secondary boom. This enables the grasping and handling at and forward of the debris collection area of large, unwieldy items of debris which may be encountered in certain debris collection operations. This permits the vessel to continue debris collection operations notwithstanding encountering large, unwieldy debris items of the sort that would oblige previously existing vessels to halt operations to separately address such debris items.

The pincers, relative to the primary boom, are preferably movable on the secondary boom from a position within the bucket to a position forward of the bucket. When the pincers are not needed they may be stationed in the bucket and positioned so as to interfere as little as possible with the debris collection function of the bucket.

BRIEF DESCRIPTION OF DRAWINGS

Like reference numerals refer to like parts throughout the several views of the drawings.

DETAILED DESCRIPTION OF THE PREFERRED EMBODIMENT

The marine vessel 1 as best seen in FIGS. 1, 2, 3 and 4 includes a tapered bow 2 and stern drive motors 5*a* and 5*b* which provide the motive means for the vessel. The majority of the controls for the vessel (not shown) are located in wheelhouse 6 which itself is positioned near the rear of the vessel.

Figure 1:
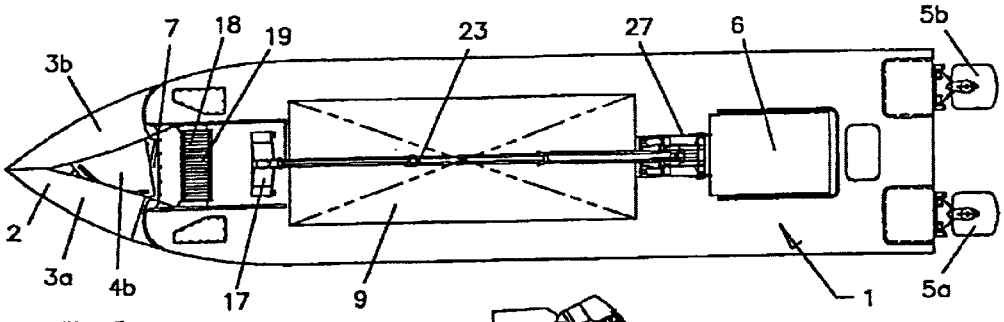
FIG. 1 is a top plan illustrating a marine vessel constructed in accordance with the invention.
Figure 4:
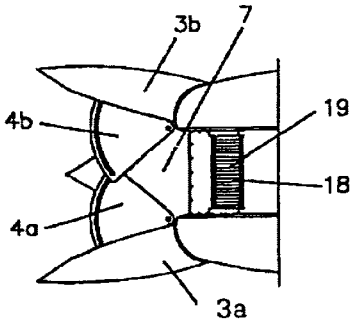
FIG. 4 is a top view of the bow portion of the vessel seen in FIG. 1 with the port and starboard bow sections open.

The bow 2 is comprised of port and starboard bow sections 3*a* and 3*b*, respectively, which are shown in FIG. 1 in the bow closed position, and in FIG. 4, in the bow open position. The vessel normally assumes the bow closed position when travelling to and from debris collection locations for vessel speed purposes. Bow sections 3*a* and 3*b* are illustrated in FIG. 4 in the bow open position in order to capture debris when the vessel is in its operative mode and which may be when it is stationary or moving at a low speed. Also shown in FIG. 4 are guide plates 4*a* and 4*b*, which guide opening and closing bow sections 3*a* and 3*b* in a manner known in the art.

Figure 2:
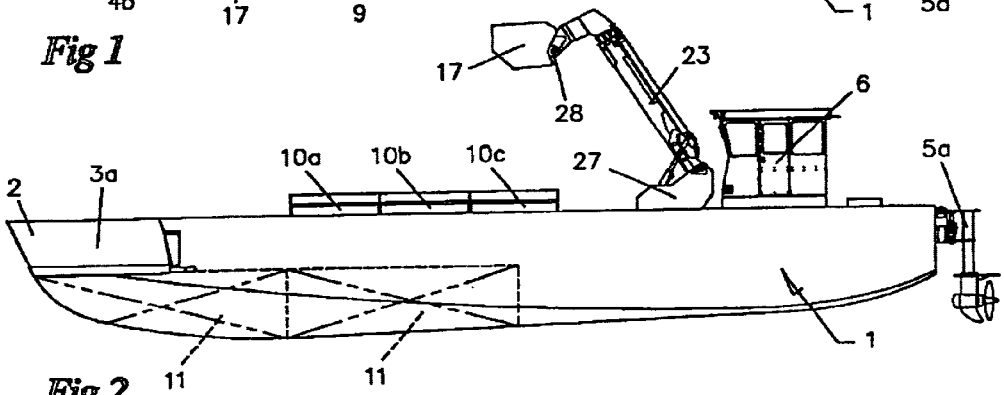
FIG. 2 is a side elevation view of the marine vessel of FIG. 1, and also showing internal ballast tanks, the debris collection bucket in its second position and debris collection containers.
Figure 3:
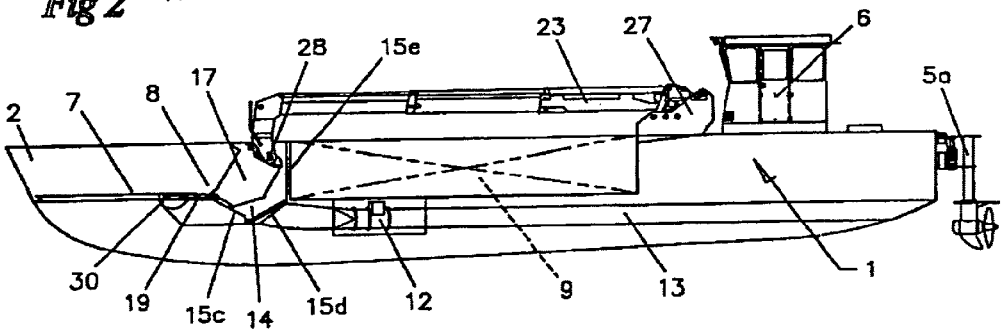
FIG. 3 is a similar side elevation view of the vessel of FIG. 1 but shows the internal debris collection area, the internal debris dumping area, the internal conduit through which water moves as it travels through the vessel and internal means for causing water to so flow.

Positioned between bow sections 3*a* and 3*b* is apron 7. Debris collection area 8 is located aft of apron 7. Debris dumping area 9, as seen in dashed lines in FIG. 3, is located midships and aft of debris collection area 8. Ballast means comprising water ballast tanks 11, as seen in dashed lines in FIG. 2, are located forward and low in the vessel. Employing suitable pumps (not shown) but well known in the art, the volume of water in the tanks can be varied thereby raising or lowering apron 7 relative to the surrounding water. Apron 7 is lowered below the surface level of the surrounding water during debris collection operations to permit the flow of water thereover and through the vessel, and having passed over the apron, then passes through open chamber 14 and water discharge conduit 13. A continuous flow of water over apron 7, through open chamber 14 which is in water communication with water discharge conduit 13 is achieved using a pump, such as axial pump 12 also seen in FIG. 3.

Figure 5:
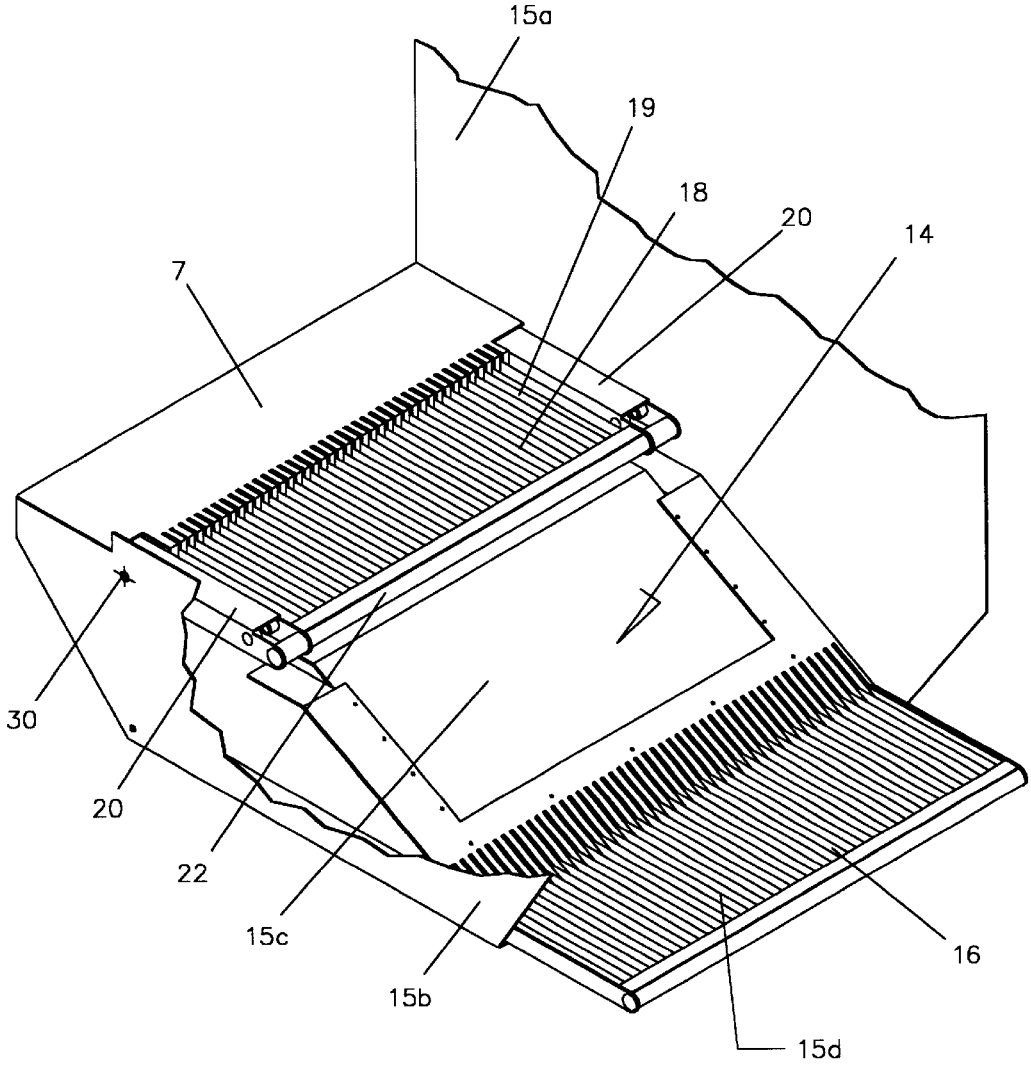
FIG. 5 is a rear cut-away perspective view of the apron, open chamber and the gate means in the gate open position, with the bucket being omitted for clarity.

During debris collection operations, water and floating debris are carried over apron 7 and into debris collection area 8. Debris collection area 8 is located downstream of apron 7 and includes the inside of debris collection bucket 17 when in open chamber 14. Open chamber 14 having, as best seen in FIG. 5, defining walls including two side walls 15*a* and 15*b*, downwardly and rearwardly inclined bottom wall 15*c*, Rear bottom wall 15*d* and back wall 15*e* as seen in FIG. 3. Rear bottom wall 15*d* further includes water passageways 16 therethrough and which communicates with water discharge conduit 13, as described above.

As also best seen in FIG. 5, gate means in the form of a hinged gate 19, shown in the gate open position, is located on apron 7 and forward of rear bottom wall 15*d* and is pivotable about gate axis 30 for reasons discussed in further detail below. Like rear bottom wall 15*d,* gate 19 is provided with water passageways 18 to permit the continuous flow of water therethrough whilst impeding entry of debris into open chamber 14 when gate 19 is pivoted upwards in its gate closed position as seen in dashed lines in FIG. 7 and as also discussed below.

Figure 6A:
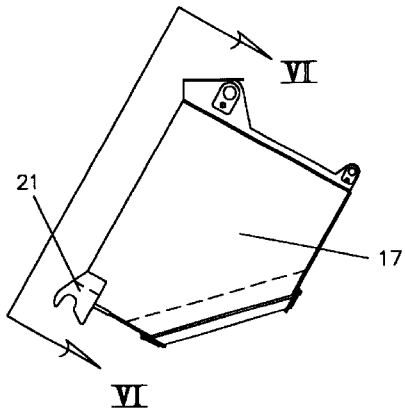
FIGS. 6*a* and 6*b* are, respectively, a side view of the bucket and a view of the bucket along line VI—VI shown in FIG. 6*a*.
Figure 6B:
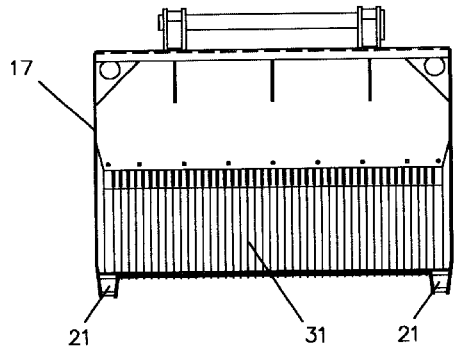

As generally illustrated in FIGS. 1, 2 and 3, and in detail in FIGS. 6*a* and 6*b,* debris collection bucket 17 is pivotally connected to primary extensible boom 23 by means of a pivot bar 28 carried on bucket 17. Boom 23 in turn is pivotally attached to the vessel by means of a pivot base 27, between wheelhouse 6 and debris dumping area 9. Bucket 17 includes water passageways 31, the purpose of which is to strain debris from the incoming water when the bucket is located in open chamber 14 while allowing the water to flow through water passageways 31 in bucket 17; after which the water flows into open chamber 14, through water passageways 16 and into water discharge conduit 13, as previously discussed.

Debris which is captured by bucket 17 when in debris collection area 8 is subsequently dumped in one or more suitable containers 10*a,* 10*b* or 10*c* loaded in debris dumping area 9. Debris dumping area 9 can accommodate several standard roll on or front loading debris containers, shown as 10*a,* 10*b* and 10*c* in FIGS. 2 and 7.

Figure 7:
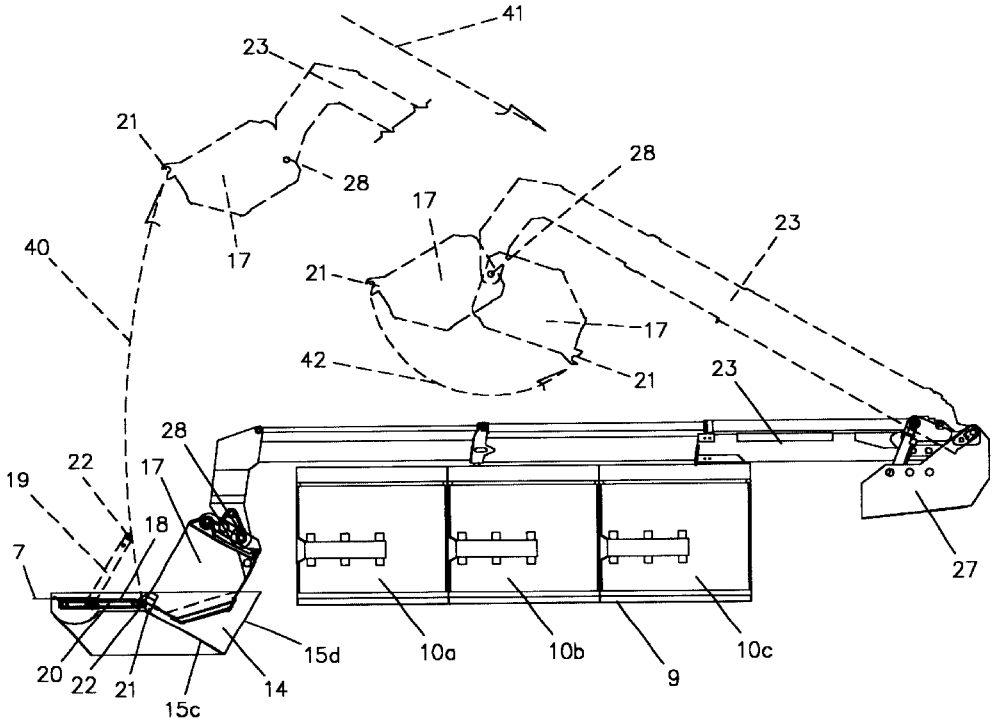
FIG. 7 is a side elevation view of the bucket, gate means, primary boom, bucket and debris containers illustrating the cooperation between and relative motion of the bucket and gate means when the bucket moves from its first position to its second position.

FIG. 7 best depicts the movement of bucket 17 during the debris collection and dumping operations. Bucket 17 when located in open chamber 14, by virtue of extension fingers 21 on the bucket which engage extension finger receiving means in the form of pivot bar 22 extending across the top free end of gate 19, holds gate 19 in the gate open position thereby permitting water and floating debris to enter bucket 17. As bucket 17 is moved out of its first position, as shown in dashed lines, gate 19 which is biased toward the gate closed position is permitted to close, disengaging itself from extension fingers 21.

The biasing means, housed in protective cover 20 as best seen in FIG. 5, may be in the form of one or more compression springs, not shown but well known in the art, which at one end are connected to the hull and at the other to or proximate to pivot bar 22. It will be understood that the gate 19 as shown in FIG. 5 is illustrated in the gate open position but that it would not normally take that position unless bucket 17 was located within open chamber 14, as discussed above.

As illustrated in dashed lines in FIG. 7, bucket 17 carried by boom 23 is initially swung upward along an arcuate path depicted by arrow 40 and as indicated previously, while simultaneously permitting gate 19 to pivot upwardly into it gate closed position thereby preventing the entry of debris into the open chamber 14 when the bucket 17 is not in debris collection area 8. Boom 23 is then retracted in the direction of arrow 41 to a selected position above debris dumping area 9; with physical dumping of the debris taking place when the bucket 17 is in arcuately pivoted downwardly as seen with reference to direction arrow 42. The telescopic extension and retraction of the boom as well as the raising and lowering of the boom and the pivoting of the bucket is achieved by hydraulic or other means which is well known in the art.

Figure 8:
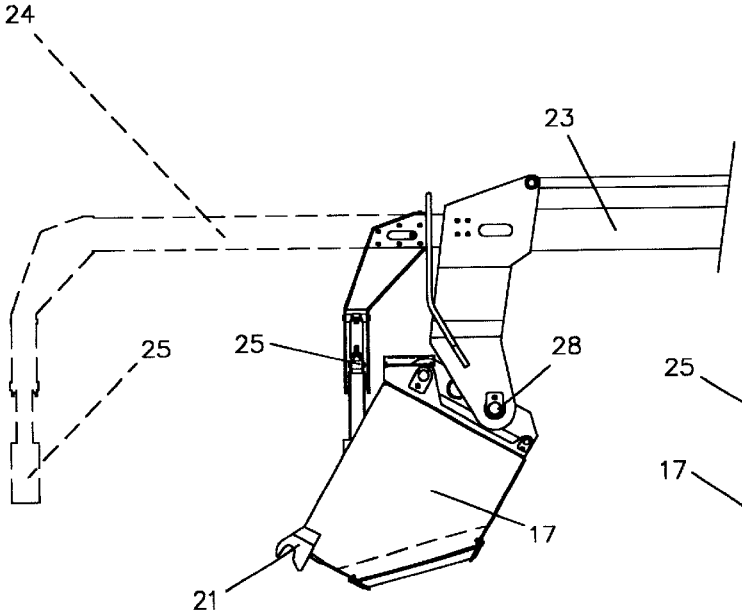
FIG. 8 is a side view of the bucket attached to the primary extension boom which further includes a secondary extension boom to which is attached grappling means, with the grappling means shown stationed in the bucket and extended forward of the bucket.
Figure 9:
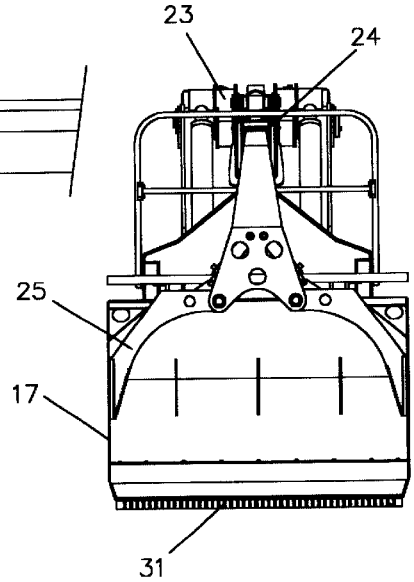
FIG. 9 is a front elevation view of the bucket and the pair of pincers located inside the bucket.

FIGS. 8 and 9, illustrate a further embodiment of the invention, wherein provision is made for a secondary extension boom 24 carried by the primary boom 23 and which at its free end includes grappling means 25, in the form of a pair of pincers, which inter alia can be employed in clearing "debris jams" or grasping and holding large and unwieldy debris items located at or forward of the apron.

FIG. 9 is front view of pincers 25 located within bucket 17 and arranged so as to minimize interference with the ingress of debris into bucket 17. The grappling and holding movement of the pincers is effected by hydraulic or other means (not shown) but well known in the art.

Prior to operation, the stationary or slowly moving vessel is lowered relative to the surrounding water by means of ballast tanks 11 so that apron 7 is below the surface level of the surrounding water. Bow sections 3*a* and 3*b* are fully opened, the bucket is in the collection area 8 and gate 19 is in the gate open position. Pump 12 in water discharge conduit 13 causes water and floating debris to continuously flow over apron 7 and gate 19 with debris and water separation taking place in bucket 17.

When a sufficient amount of debris has been collected in bucket 17, it is moved from its first position in open chamber 14, while simultaneously allowing gate 19, which is biased upwardly, to move to its gate closed position. The cooperation of bucket 17 and gate 19 during this operation prevents debris from lodging on top of gate 19 or entering the open chamber 14 when the bucket is removed therefrom, and then brought to the second position at debris dumping area 9 by the vertical pivoting and retraction of primary extensible boom 23 to which it is attached. The debris is dumped in one of debris containers 10*a,* 10*b* or 10*c* by the pivoting of bucket 17 at the end of primary extensible boom 23. After dumping is completed, bucket 17 is returned to its first position, at which time gate 19 is moved synchronically to its gate open position, and the process is repeated.

I claim:

1. A marine vessel used for collecting floating debris from surrounding water and which vessel includes a hull having a tapered bow, port and starboard bow sections moveable laterally between bow open and bow closed positions, an apron located between said bow sections, a debris collection area aft of said apron, a debris dumping area midships and aft of said debris collection area, ballast means for selectively locating said apron between positions above and below said surrounding water, means for causing said surrounding water to flow over said apron and through said debris collection area when said apron is below said surrounding water, said vessel being further characterized by:

an open chamber located below said apron and which has defining walls which include water passageways therethrough;

a debris collection bucket having water passageways extending therethrough;

means for moving said bucket between a first position when said bucket is located in said open chamber and a second position when said bucket is located at said debris dumping area; and gate means on said apron which gate means cooperates with said bucket, said gate means being moveable between a gate open position when said bucket is located in said open chamber to thereby permit debris to enter into the debris collection area, and a gate closed position above said apron to impede entry of debris into said debris collection area as said bucket is moved from said first position to said second position.

2. The marine vessel as claimed in claim 1 wherein said gate means includes means for biasing the gate means in the gate closed position.

3. The marine vessel as claimed in claim 2 wherein said bucket includes one or more extension fingers on said bucket which fingers are engagable with a corresponding number of extension finger receiving means included on said gate means.

4. The marine vessel as claimed in claim 3 wherein said extension fingers on said bucket, when in said first position, maintain said gate means in the gate open position.

5. The marine vessel as claimed in claim 4 wherein said gate means include water passageways therethrough.

6. The marine vessel as claimed in claim 5, further including a primary boom which extends centrally and longitudinally of said vessel with one of the boom ends being pivotally connected to said vessel rearward of said debris dumping area and the other of said ends being pivotally connected to said bucket and wherein the boom is telescopically and vertically movable between said debris collection area and said debris dumping area.

7. The marine vessel as claimed in claim 6 wherein said bucket is pivotally movable from a debris holding position in the said debris collection area to a debris dumping position when in said debris dumping area.

8. The marine vessel as claimed in claim 7 wherein a secondary boom, telescopically movable relative to said primary boom and located at said other end of said primary boom and having grappling means located at the distal end of said secondary boom for grappling debris forward of said debris collection area.

9. The marine vessel as claimed in claim 8 wherein said grappling means includes a pair of pincers pivotally connected to the distal end of said secondary boom.

10. The marine vessel as claimed in claim 9 wherein said pincer means, relative to said primary boom, are movable on said secondary boom from a position within said bucket to a position forward of said bucket.

11. A marine vessel used for collecting floating debris from surrounding water and which vessel includes a hull having a tapered bow, port and starboard bow sections moveable laterally between bow open and bow closed positions, an apron located between said bow sections, a debris collection area aft of said apron, a debris dumping area midships and aft of said debris collection area, ballast means for selectively locating said apron between positions above and below said surrounding water, means for causing said surrounding water to flow over said apron and through said debris collection area when said apron is below said surrounding water, a debris collection bucket having water passageways extending therethrough, means for moving said bucket between a first position for the collection of debris, when said bucket is located in said open chamber and a second position for the purpose of discharging debris from said bucket midships of the vessel when said bucket is located rearward of said debris collection area, said vessel being further characterized by:

a primary boom which extends centrally and longitudinally of said vessel with one of the boom ends being pivotally connected to said vessel rearward of said debris dumping area and the other of said ends being pivotally connected to said bucket and wherein the boom is telescopically and vertically movable between said debris collection area and said debris dumping area.

12. The marine vessel as claimed in claim 11 wherein said bucket is pivotally movable from a debris holding position in the said debris collection area to a debris dumping position when in said debris dumping area.

13. The marine vessel as claimed in claim 12 wherein a secondary boom, telescopically movable relative to said primary boom and located at said other end of said primary boom and having grappling means located at the distal end of said secondary boom for grappling debris forward of said debris collection area.

14. The marine vessel as claimed in claim 13 wherein said grappling means includes a pair of pincers pivotally connected to the distal end of said secondary boom.

15. The marine vessel as claimed in claim 14 wherein said pincer means, relative to said primary boom, are movable on said secondary boom from a position within said bucket to a position forward of said bucket.

16. The marine vessel claimed in claim 15 further including:

an open chamber located below said apron and which has defining walls which include water passageways therethrough;

a debris collection bucket having water passageways extending therethrough;

means for moving said bucket between a first position when said bucket is located in said open chamber and a second position when said bucket is located at said debris dumping area; and gate means on said apron which gate means cooperates with said bucket, said gate means being moveable between a gate open position when said bucket is located in said open chamber to thereby permit debris to enter into the debris collection area, and a gate closed position above said apron to impede entry of debris into said debris collection area as said bucket is moved from said first position to said second position.

17. The marine vessel as claimed in claim 16 wherein said gate means includes means for biasing the gate means in the gate closed position.

18. The marine vessel as claimed in claim 17 wherein said bucket includes one or more extension fingers on said bucket which fingers are engagable with a corresponding number of extension finger receiving means included on said gate means.

19. The marine vessel as claimed in claim 18 wherein said extension fingers on said bucket, when in said first position, maintain said gate means in the gate open position.

20. The marine vessel as claimed in claim 19 wherein said gate means include water passageways therethrough.

21. A marine vessel used for collecting floating debris from surrounding water and which vessel includes a hull having a tapered bow, port and starboard bow sections moveable laterally between bow open and bow closed positions, an apron located between said bow sections, a debris collection area aft of said apron, a debris dumping area midships and aft of said debris collection area, ballast means for selectively locating said apron between positions above and below said surrounding water, means for causing said surrounding water to flow over said apron and through said debris collection area when said apron is below said surrounding water, said vessel being further characterized by:

(a) an open chamber located below said apron and which has defining walls which include water passageways therethrough;

(b) a debris collection bucket having water passageways extending therethrough;

(c) means for moving said bucket between a first position when said bucket is located in said open chamber and a second position when said bucket is located at said debris dumping area;

(d) gate means on said apron which gate means cooperates with said bucket, said gate means being moveable between a gate open position when said bucket is located in said open chamber to thereby permit debris to enter into the debris collection area, and a gate closed position above said apron to impede entry of debris into said debris collection area as said bucket is moved from said first position to said second position; and (e) a primary boom which extends centrally and longitudinally of said vessel with one of the boom ends being pivotally connected to said vessel rearward of said debris dumping area and the other of said ends being pivotally connected to said bucket and wherein the boom is telescopically and vertically movable between said debris collection area and said debris dumping area.

22. The marine vessel as claimed in claim 21 wherein said gate means includes means for biasing the gate means in the gate closed position.

23. The marine vessel as claimed in claim 22 wherein said bucket includes one or more extension fingers on said bucket which fingers are engagable with a corresponding number of extension finger receiving means included on said gate means.

24. The marine vessel as claimed in claim 23 wherein said extension fingers on said bucket, when in said first position, maintain said gate means in the gate open position.

25. The marine vessel as claimed in claim 24 wherein said gate means include water passageways therethrough.

26. The marine vessel as claimed in claim 25 wherein said bucket is pivotally movable from a debris holding position in the said debris collection area to a debris dumping position when in said debris dumping area.

27. The marine vessel as claimed in claim 26 wherein a secondary boom, telescopically movable relative to said primary boom and located at said other end of said primary boom and having grappling means located at the distal end of said secondary boom for grappling debris forward of said debris collection area.

28. The marine vessel as claimed in claim 27 wherein said grappling means includes a pair of pincers pivotally connected to the distal end of said secondary boom.

29. The marine vessel as claimed in claim 28 wherein said pincer means, relative to said primary boom, are movable on said secondary boom from a position within said bucket to a position forward of said bucket.

* * * * *